US007986314B2

(12) United States Patent
Tsai et al.

(10) Patent No.: US 7,986,314 B2
(45) Date of Patent: Jul. 26, 2011

(54) OVER-DRIVE DEVICE AND METHOD THEREOF

(75) Inventors: Pei-Ting Tsai, Taitung (TW); Wen-Min Lu, Hsinchu (TW)

(73) Assignee: Etron Technology, Inc., Hsinchu (TW)

( * ) Notice: Subject to any disclaimer, the term of this patent is extended or adjusted under 35 U.S.C. 154(b) by 729 days.

(21) Appl. No.: 12/127,791

(22) Filed: May 27, 2008

(65) Prior Publication Data

US 2009/0245394 A1 Oct. 1, 2009

(30) Foreign Application Priority Data

Mar. 26, 2008 (TW) ..... 97110738 A

(51) Int. Cl.
*G09G 5/00* (2006.01)

(52) U.S. Cl. ..... 345/204; 345/690

(58) Field of Classification Search ..... 345/87–102, 345/204, 690, 698
See application file for complete search history.

(56) References Cited

U.S. PATENT DOCUMENTS

| | | | | |
|---|---|---|---|---|
| 6,081,209 | A * | 6/2000 | Schuyler et al. | 341/51 |
| 7,696,988 | B2 * | 4/2010 | Wu et al. | 345/204 |
| 7,724,971 | B2 * | 5/2010 | Huang et al. | 382/236 |
| 2005/0200631 | A1 * | 9/2005 | Pan et al. | 345/600 |
| 2008/0212875 | A1 * | 9/2008 | Lee et al. | 382/166 |
| 2009/0002298 | A1 * | 1/2009 | Furukawa | 345/88 |
| 2009/0009461 | A1 * | 1/2009 | Chia et al. | 345/99 |
| 2009/0244086 | A1 * | 10/2009 | Miyasaka et al. | 345/589 |
| 2010/0289779 | A1 * | 11/2010 | Routley et al. | 345/205 |

FOREIGN PATENT DOCUMENTS

| | | | |
|---|---|---|---|
| JP | 2007097145 | A | 4/2007 |
| KR | 100498457 | B1 | 7/2005 |
| KR | 1020060000624 | A | 1/2006 |
| KR | 1020080025849 | A | 3/2008 |

* cited by examiner

*Primary Examiner* — Nitin Patel
(74) *Attorney, Agent, or Firm* — Winston Hsu; Scott Margo

(57) ABSTRACT

A method for data compressing includes compressing an original data with DPCM, compressing again the compressed data with Huffman's encoding for generating a bit-stream, and storing the bit-stream.

13 Claims, 9 Drawing Sheets

| | Over-drive table | | | | | | | | | | | |
|---|---|---|---|---|---|---|---|---|---|---|---|---|
| F2 \ F1 | 0 | 1 | 2 | 3 | 4 | 5 | 6 | 7 | 8 | 9 | ····· | 255 |
| 0 | 0 | ··· | ··· | ··· | ··· | ··· | ··· | ··· | ··· | ··· | ····· | ··· |
| 1 | 2 | ··· | ··· | ··· | ··· | ··· | ··· | ··· | ··· | ··· | ····· | ··· |
| 2 | 3 | ··· | ··· | ··· | ··· | ··· | ··· | ··· | ··· | ··· | ····· | ··· |
| 3 | 4 | ··· | ··· | ··· | ··· | ··· | ··· | ··· | ··· | ··· | ····· | ··· |
| 4 | 6 | ··· | ··· | ··· | ··· | ··· | ··· | ··· | ··· | ··· | ····· | ··· |
| 5 | 8 | ··· | ··· | ··· | ··· | ··· | ··· | ··· | ··· | ··· | ····· | ··· |
| 6 | 11 | ··· | ··· | ··· | ··· | ··· | ··· | ··· | ··· | ··· | ····· | ··· |
| 7 | 15 | ··· | ··· | ··· | ··· | ··· | ··· | ··· | ··· | ··· | ····· | ··· |
| 8 | 19 | ··· | ··· | ··· | ··· | ··· | ··· | ··· | ··· | ··· | ····· | ··· |
| 9 | 25 | ··· | ··· | ··· | ··· | ··· | ··· | ··· | ··· | ··· | ····· | ··· |
| ⋮ | ⋮ | ⋮ | ⋮ | ⋮ | ⋮ | ⋮ | ⋮ | ⋮ | ⋮ | ⋮ | ⋮ | ⋮ |
| 255 | ··· | ··· | ··· | ··· | ··· | ··· | ··· | ··· | ··· | ··· | ····· | ··· |

FIG. 1 PRIOR ART

| Reduced over-drive table | | | | | | | | | |
|---|---|---|---|---|---|---|---|---|---|
| F2 \ F1 | 0 | 32 | 64 | 96 | 128 | 160 | 192 | 224 | 255 |
| 0 | 0 | 38 | 79 | 122 | 162 | 195 | 227 | 248 | 255 |
| 32 | 0 | 32 | 70 | 109 | 149 | 186 | 219 | 245 | 255 |
| 64 | 0 | 28 | 64 | 103 | 143 | 180 | 215 | 243 | 255 |
| 96 | 0 | 26 | 59 | 96 | 135 | 174 | 210 | 240 | 255 |
| 128 | 0 | 24 | 55 | 90 | 128 | 168 | 206 | 239 | 255 |
| 160 | 0 | 22 | 51 | 83 | 120 | 160 | 200 | 236 | 255 |
| 192 | 0 | 20 | 46 | 75 | 110 | 149 | 192 | 231 | 255 |
| 224 | 0 | 16 | 39 | 66 | 98 | 136 | 181 | 224 | 255 |
| 255 | 0 | 11 | 30 | 55 | 84 | 120 | 165 | 210 | 255 |

FIG. 2 PRIOR ART

OVER-DRIVE DEVICE AND METHOD THEREOF

BACKGROUND OF THE INVENTION

1. Field of the Invention

The present invention relates to a method for data processing, and more particularly, to a method for data compressing/decompressing.

2. Description of the Prior Art

Please refer to FIG. 1. FIG. 1 is a diagram illustrating a raw over-drive table without compression. Generally, for enhancing response time of liquid crystal particles in a Liquid Crystal Display (LCD), manner of over-driving is used when liquid crystal particles are driven. The liquid crystal particles of one pixel of the LCD can be driven with a corresponding over-drive grey level according to the original grey levels of the pixel in a current frame and the frame previous to the current frame. An appropriate over-drive grey level can be looked up in the over-drive table as illustrated in FIG. 1 and be used to drive the pixel for enhancing the response time of the pixel. As shown in FIG. 1, F1 (column) represents the original grey level of one pixel in one frame (the previous frame), and F2 (row) represents the original grey level of the pixel in the frame next to the frame (the current frame). Under the condition that one color is divided into 256 grey levels (8 bits), the over-drive table sizes up to 256×256×256 bits (equals to 32 Kbytes). However, a normal driving chip for LCD cannot afford that big size to store all the data of the over-drive grey levels.

Please refer to FIG. 2. FIG. 2 is a diagram illustrating an over-drive table after reduction. As shown in FIG. 2, the data in the table of FIG. 2 is reduced by decreasing the resolution of the table of FIG. 1 and abandoning some data in the table of FIG. 1. For example, if the original grey level of one pixel in the previous frame falls in the range between the grey levels "0"~"32", and the original grey level of that pixel in the current frame falls in the range between the grey levels "32"~"64", the corresponding over-drive grey level is grey level "0". In this way, the over-drive table of FIG. 2 can be reduced to 8×8×256 bits (64 bytes), which is obviously much smaller than the raw over-drive table of FIG. 1. However, the reduction from the table of FIG. 1 to the table of FIG. 2 results in insufficiently over-driving, decreasing the response time of the liquid crystal particles, and distortion in the displayed frames.

Please refer to FIG. 3. FIG. 3 is a diagram illustrating a conventional over-drive device 10. As shown in FIG. 3, the over-drive device 10 comprises a determining device 41, an over-drive table 42, and a memory device 43. The over-drive table 42 stores a plurality of over-drive grey levels. Each over-drive grey level represents a corresponding voltage according to a gamma curve disposed for the LCD. Therefore, a pixel can be over-driven by the voltage corresponding to one over-drive grey level according to the gamma curve. Assuming a plurality of frames are displayed on the LCD, hereinafter only two adjacent frames "f", and "f−1" of the plurality of the frames are illustrated for the operation of the over-drive device 10, where the frame "f−1" represents a frame previous to the frame "f", $P_{(f-1,n)}$ represents an original grey level of a pixel "n" in the frame "f−1", and $P_{(f,n)}$ represents an original grey level of a pixel "n" in the frame "f". The memory device 43 stores original grey levels of all pixels in one frame "f−1". When the LCD completes displaying the frame "f−1" and is going to display frame "f", the determining device 41 chooses an over-drive grey level from the over-drive table 42 according to the original grey levels $P_{(f,n)}$ and $P_{(f-1,\ n)}$ for over-driving the pixel "n" in the frame "f". For example, when the original grey level $P(_{f,n})$ is "32" (as the rows shown in FIG. 2), and the original grey level $P_{(f-1,n)}$ is "128" (as the columns shown in FIG. 2), the corresponding over-drive grey level is "24".

SUMMARY OF THE INVENTION

The present invention provides an over-drive device. The over-drive device comprises a memory device, an over-drive module, and a determining device. The memory device is disposed for storing a first frame. The first frame comprises a first original grey level for a pixel. The over-drive module comprises a compressed over-drive table for storing a plurality of over-drive grey levels, a table decompressing device for decompressing the plurality of the over-drive grey levels of the compressed over-drive table, and a table buffer for storing the plurality of the over-drive grey levels decompressed from the table decompressing device. The determining device is disposed for receiving a second original grey level of a second frame for the pixel and selecting one of the plurality of the decompressed over-drive grey levels from the table buffer according to the first original grey level for the pixel and the second original grey level for the pixel.

The present invention further provides a method for over-driving a pixel of a liquid crystal display (LCD) with a compressed over-drive table. The method comprises compressing a first over-drive table by DPCM for generating a second over-drive table, and compressing the second over-drive table by Huffman's coding according to a code book for generating the compressed over-drive table.

The present invention further provides a method for compressing a first frame to be a compressed frame and decompressing the compressed frame to be the first frame. The method comprises compressing the first frame by DPCM for generating a second frame, and compressing the second frame by Huffman's coding according to a code book for generating the compressed frame.

These and other objectives of the present invention will no doubt become obvious to those of ordinary skill in the art after reading the following detailed description of the preferred embodiment that is illustrated in the various figures and drawings.

BRIEF DESCRIPTION OF THE DRAWINGS

FIG. 1 is a diagram illustrating a raw over-drive table without compression.

FIG. 2 is a diagram illustrating an over-drive table after reduction.

DETAILED DESCRIPTION

Figure 3:
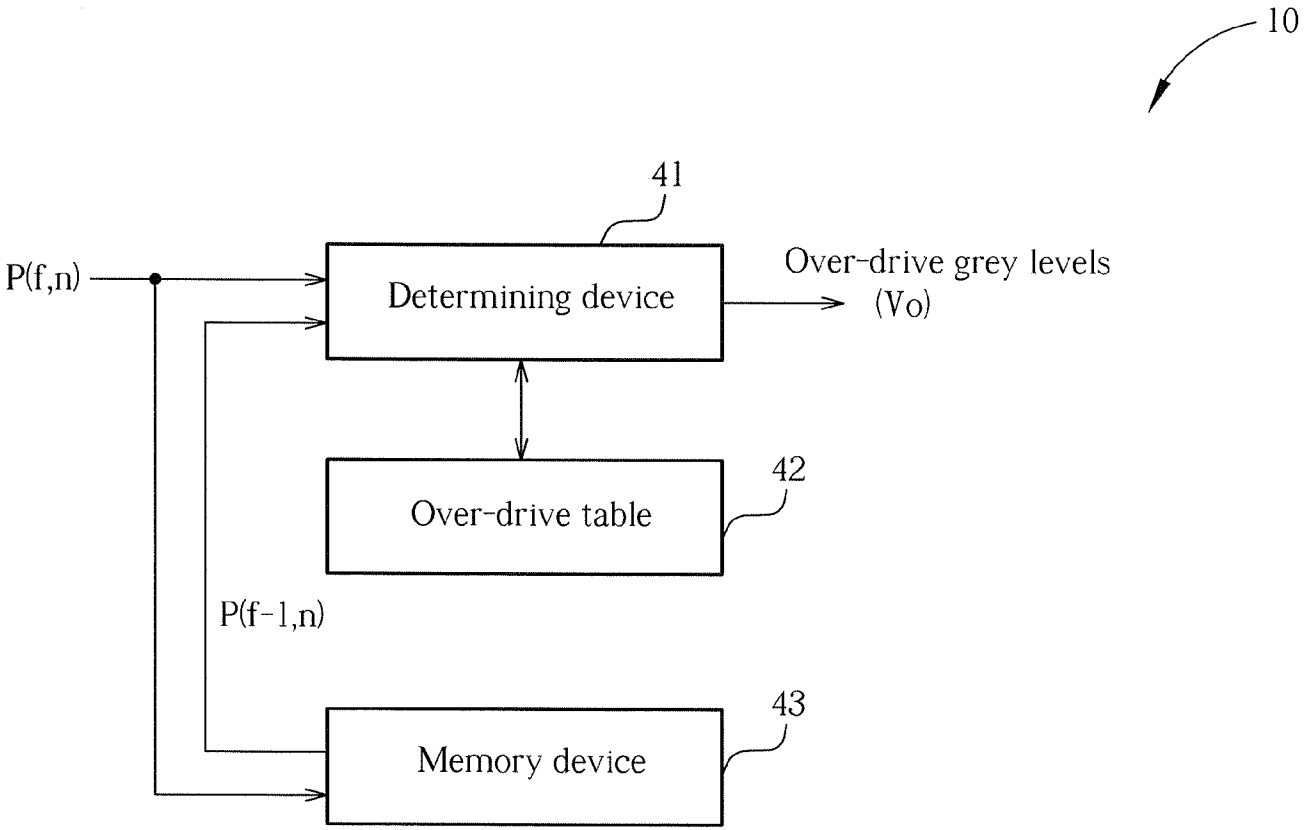
FIG. 3 PRIOR ART
FIG. 3 is a diagram illustrating a conventional over-drive device.
Figure 4:
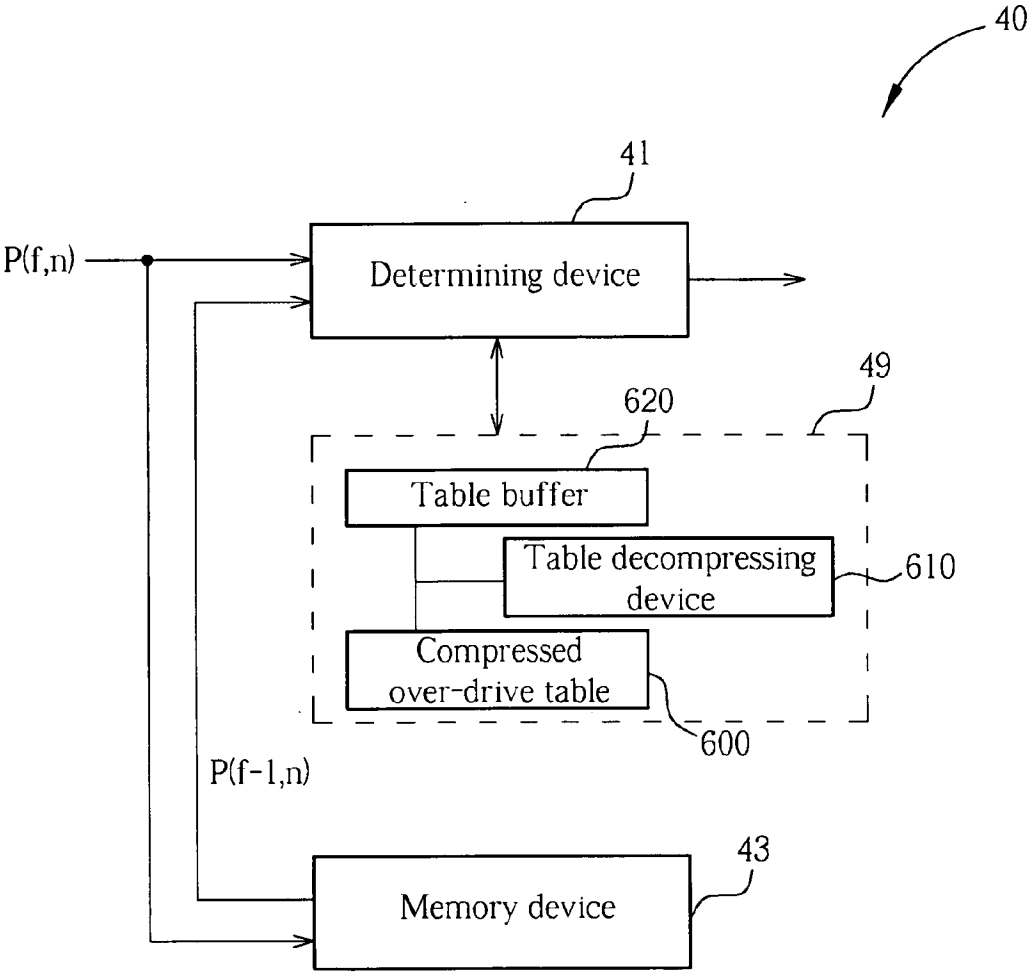
FIG. 4 is a diagram illustrating an over-drive device according to a first embodiment of the present invention.

Please refer to FIG. 4. FIG. 4 is a diagram illustrating an over-drive device 40 according to a first embodiment of the present invention. The over-drive device 40 comprises a determining device 41, an over-drive module 49, and a memory device 43. The memory device 43 functions as a buffer for temporarily storing one frame previous to the frame currently displayed on the LCD in order to provides the original grey levels of the pixels of the previous frame to the determining device 41.

The over-drive module 49 comprises a compressed over-drive table 600, a table decompressing device 610, and a table buffer 620. The compressed over-drive table 600 is generated by compressing the raw over-drive table 42 and similarly disposed for storing a plurality of compressed over-drive grey levels. Since the size of the compressed over-drive table is smaller, the memory space requirement for the over-drive table 600 is lower.

The table decompressing device 610 is disposed for decompressing the compressed over-drive grey levels for generating a plurality of the over-drive grey levels. The table buffer 620 is disposed for storing the plurality of the over-drive grey levels generated from decompressing the compressed over-drive grey levels.

The determining device 41 chooses an over-drive grey level (corresponding to a voltage $V_O$ according to the gamma curve) from the table buffer 620 according to the original grey levels $P_{(f,n)}$ and $P_{(f-1,n)}$.

Figure 5:
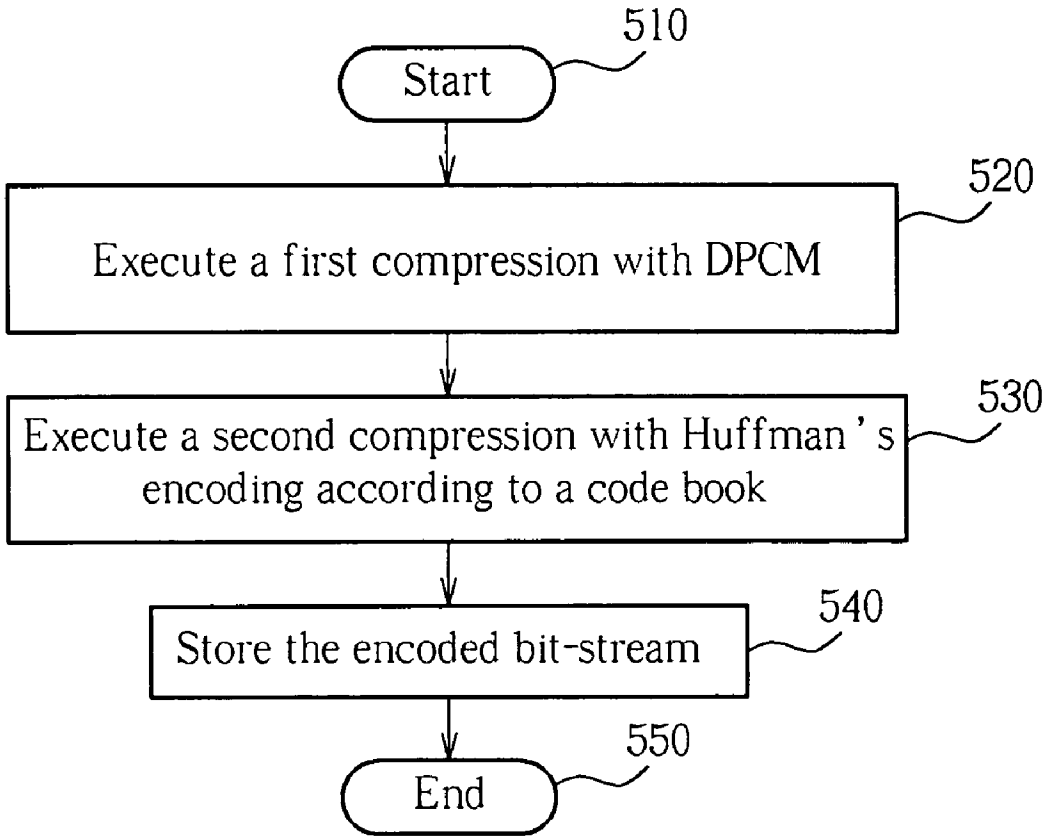
FIG. 5 is a flowchart illustrating the method for generating the compressed over-drive table.

Please refer to FIG. 5. FIG. 5 is a flowchart illustrating the method 500 for generating the compressed over-drive table 600. The steps are described as follows:

Step 510: Start;

Step 520: Execute a first compression with Differential Pulse-Code Modulation (DPCM) onto a raw over-drive table 42 for generating a compressed over-drive table 421;

Step 530: Execute a second compression with Huffman's encoding according to a code book onto the compressed over-drive table 421 for generating an encoded bit-stream 422;

Step 540: Store the encoded bit-stream 422 (the compressed over-drive table 600);

Step 550: End.

Steps 520~540 are the procedures of compressing raw the over-drive table according to the present invention. The compressed encoded bit-stream 422 is the compressed over-drive table 600 of the present invention. In this way, the encoded bit-stream 422 generated from step 540 is much smaller than the raw over-drive table 42, and thereby users can merely use a smaller storage device (for example, DRAM) to store the encoded bit-stream 422.

In step 520, the DPCM is a two-dimensional DPCM. The DPCM in step 520 can start with selecting any of the over-drive grey levels in the raw over-drive table 42 as a reference X, and then store the rest of the over-drive grey levels in the raw over-drive table 42 according to the differences between the reference X. For example, the grey level "254" is used as the reference X, which needs eight bits to store, the grey levels "255" and "253" both need eight bits to store. After DPCM in step 520, the grey level "255" becomes grey level "1" according to the reference X, and the grey level "253" becomes grey level "−1" according to the reference X. In this way, the grey levels "255" and "253" only needs one bit to store instead of eight bits as the original method needs, thereby decreasing the requirement of storage space. The characteristic of the DPCM is that when the plurality of the data are similar and do not vary much to each other, the compressing result is satisfying and efficient. Thus, when the differences between the rest of the over-drive grey levels and the reference are not much, the compression for the raw over-drive table 42 is efficient.

In step 530, the compressed over-drive table 421 is again compressed with Huffman's encoding for generating an encoded bit-stream. Users can design an appropriate code book as need so that every datum of the compressed over-drive table 421 has a corresponding code word in the code book, and the encoded bit-stream 422 can be generated by sequentially combining code words corresponding to the data of the compressed over-drive table 421. Then the encoded bit-stream 422 is stored in the storage device to be the compressed over-drive table. The advantage of Huffman's encoding is that when the probability of one datum is higher, the datum has a shorter corresponding code word, thereby achieving better compression ratio. For example, when the probability of the grey level "254" is higher, the grey level "254" can correspond to the shorter code word "0" (one bit, and the value of the bit is "0"). In this way, a single bit "0" in the encoded bit-stream represents the grey level "254", which saves enormous storage space. That is, when one over-drive grey level in the over-drive table has a higher probability, the compression ratio is better after the Huffman's encoding procedure.

Figure 6:
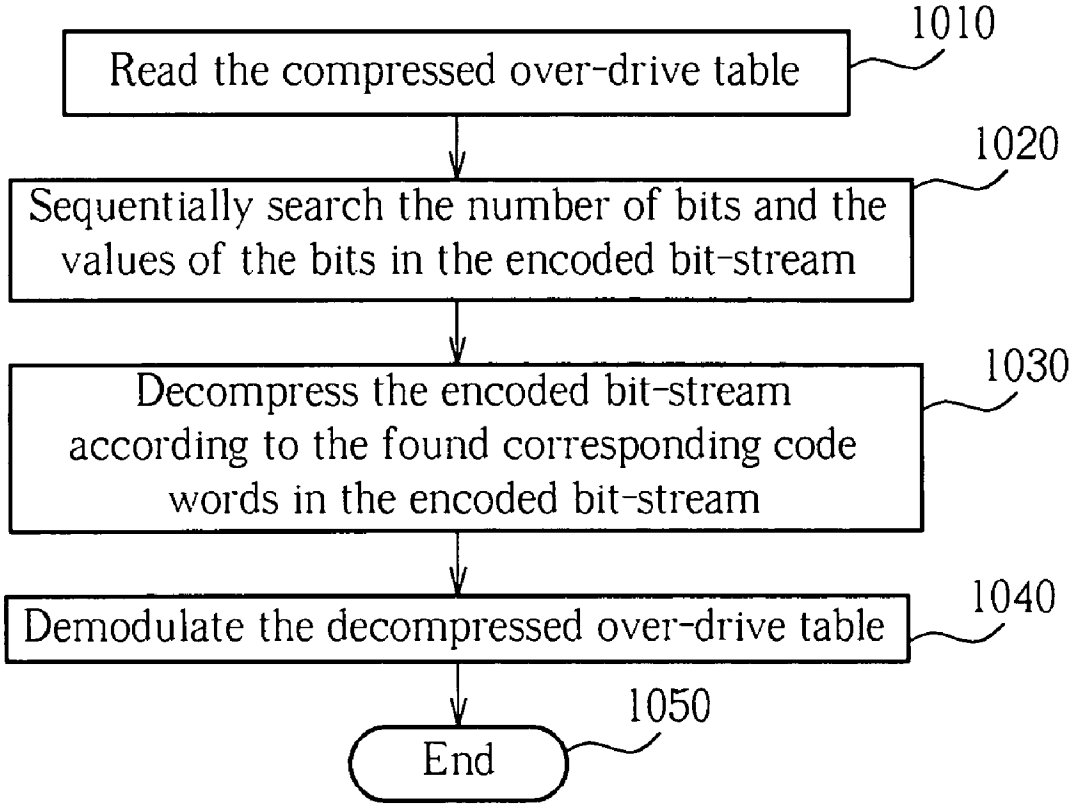
FIG. 6 is a flowchart illustrating the method for the table decompressing device reading out the compressed over-drive table and decompressing the read data.

Please refer to FIG. 6. FIG. 6 is a flowchart illustrating the method 1000 for the table decompressing device 610 reading out the compressed over-drive table 600 and decompressing the read data. The steps are described as follows:

Step 1010: Read the compressed over-drive table 600 (the encoded bit-stream 422);

Step 1020: Sequentially search the number of bits and the values of the bits in the encoded bit-stream in compliance with the code words in the code book;

Step 1030: Decompress the encoded bit-stream for generating a DPCM over-drive table 421 according to the found corresponding code words in the encoded bit-stream;

Step 1040: Demodulate (decompress) the DPCM over-drive table 421 for generating the raw over-drive table 42;

Step 1050: End.

During steps 1010 to 1040, the encoded bit-stream stored in the storage device is read and decompressed to raw over-drive table. By utilizing steps 1010 to 1040, the needed size of the storage device can be smaller.

In steps 1020 and 1030 (steps for decoding the bit-stream encoded with Huffman's encoding), each code word in the code book is saved with number of the bits of the code word and the values of each bit of the code word. In this way, the code book can be smaller. For example, when the code word is "0", the code word "0" is saved with one bit (number of the bits of the code word "0"), and with the value "0" (value of the bit of the code word "0"); when the code word is "100", the code word "100" is saved with three bits (number of the bits of the code word "100"), and with the value "100" (values of the bits of the code word "100"). Therefore, the encoded bit-stream can be decoded by the code words sequentially searched in the code book. Furthermore, when the probability of the occurrence of one code word in the encoded bit-stream goes higher, the priority of that code word is raised as well, which speeds up the step for searching. Additionally, in the steps 1020 and 1030, the encoded bit-stream can be divided into sections, and one section begins to decode after the previous section is decoded completely. Although such manner slows down the speed of decoding, the size of the code book is smaller.

Since the over-drive table 421 is generated by compressing the over-drive table 42 with the two-dimensional DPCM in step 520, the reference X also has to be stored in the over-drive table 421 in order to decompress for generating the over-drive table 42 in step 1040.

Figure 7:
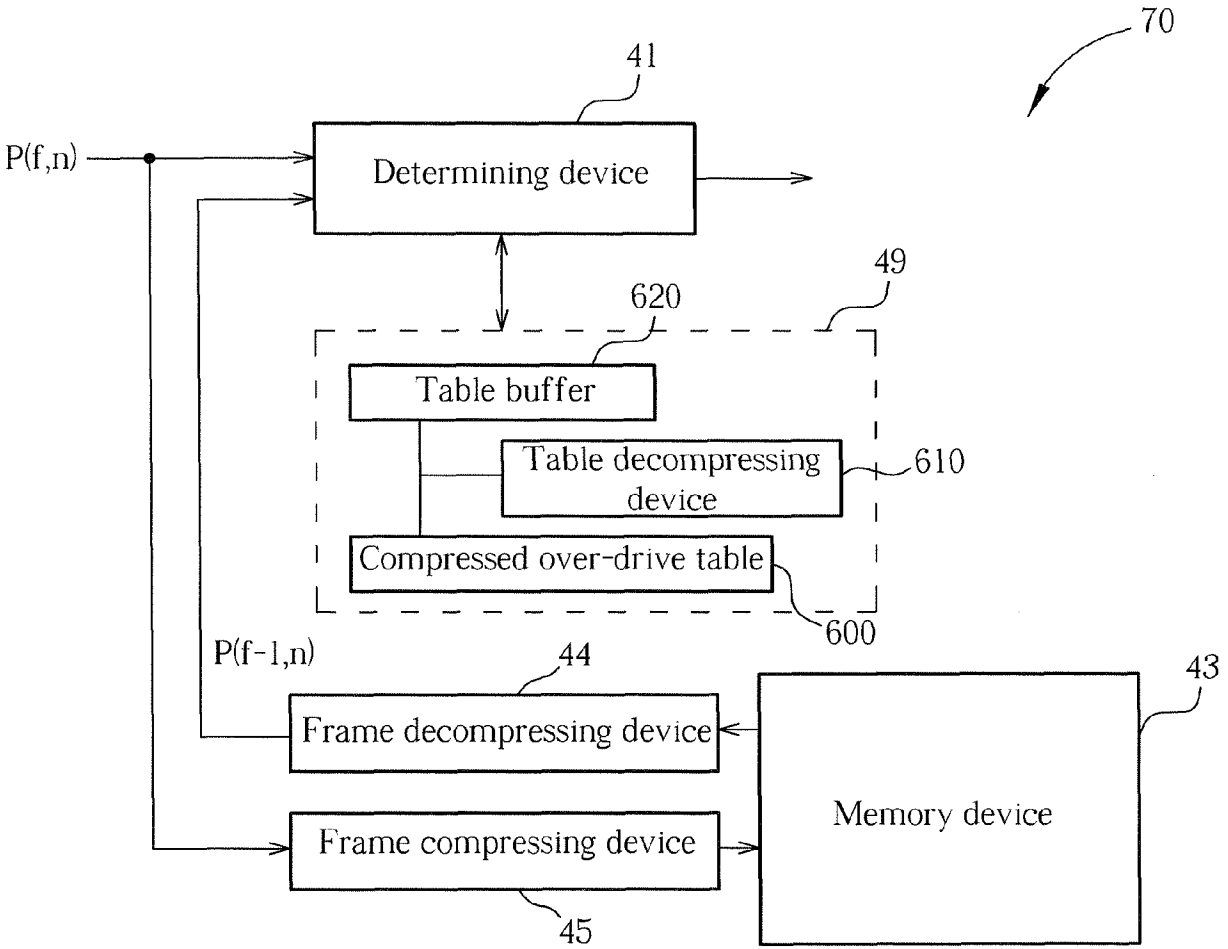
FIG. 7 is a diagram illustrating an over-drive device according to a second embodiment of the present invention.

Please refer to FIG. 7. FIG. 7 is a diagram illustrating an over-drive device 70 according to a second embodiment of the present invention. The over-drive device 70 comprises a determining device 41, an over-drive module 49, a frame decompressing device 44, a frame compressing device 45, and memory device 43. The functions of the determining device, the memory device 43, the over-drive module 49 are same as described above and the description for the operation is omitted.

The frame compressing device 45 compresses a raw frame, and the then compressed frame is stored in the memory device 43. Therefore, the size of the memory device 43 can be smaller. The frame decompressing device 44 decompresses one compressed frame read out from the memory device 43 for generating a raw frame.

Figure 8:
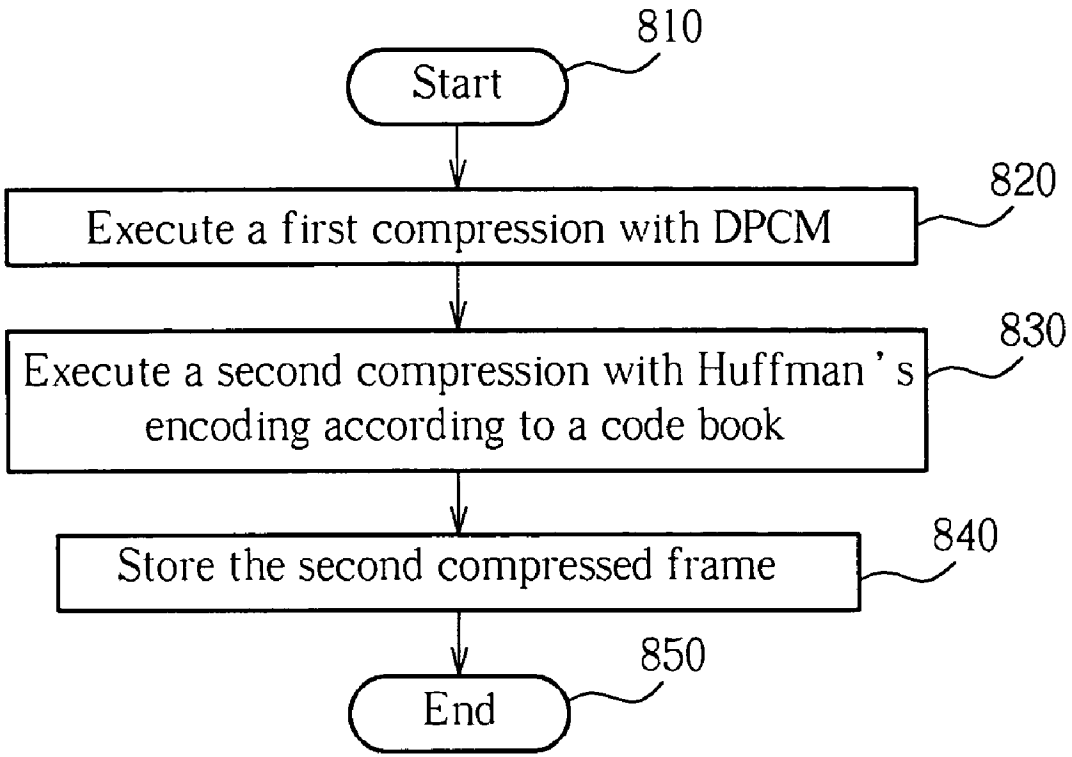
FIG. 8 is a flowchart illustrating a method for the frame compressing device compressing a raw frame for storing the compressed frame in the memory device according to the second embodiment of the present invention.

Please refer to FIG. 8. FIG. 8 is a flowchart illustrating a method 800 for the frame compressing device 45 compressing a raw frame for storing the compressed frame in the memory device 43 according to the second embodiment of the present invention. The steps are described as follows:

Step 810: Start;

Step 820: Execute a first compression with DPCM onto a raw frame for generating a first compressed frame;

Step 830: Execute a second compression with Huffman's encoding according to a code book onto the first compressed frame for generating a second compressed frame;

Step 840: Store the second compressed frame in the memory device 43;

Step 850: End.

Steps 820~840 are the procedures of compressing raw frames according to the present invention. In this way, the second compressed frame generated from step 840 is much smaller than the raw frame, and thereby users can merely use a smaller storage device (for example, DRAM) to store the second compressed frame.

In step 820, the DPCM is a two-dimensional DPCM. The DPCM in step 820 can start with selecting any of the grey levels in the raw frame as a reference X, and then store the rest of the grey levels in the raw frame according to the differences between the reference X. For example, the grey level "254" is used as the reference X, which needs eight bits to store, the grey levels "255" and "253" both need eight bits to store. After DPCM in step 520, the grey level "255" becomes grey level "1" according to the reference X, and the grey level "253" becomes grey level "−1" according to the reference X. In this way, the grey levels "255" and "253" only needs one bit to store instead of eight bits as the original method needs, thereby decreasing the requirement of storage space. The characteristic of the DPCM is that when the plurality of the data are similar and do not vary much to each other, the compressing result is satisfying and efficient. Thus, when the differences between the rest of the grey levels and the reference are not much, the compression for the raw frame is efficient.

In step 830, the first compressed frame is again compressed with Huffman's encoding for generating the second compressed frame (an encoded bit-stream). Users can design an appropriate code book as need so that every datum of the first compressed frame has a corresponding code word in the code book, and the second compressed frame can be generated by sequentially combining code words corresponding to the data of the first compressed frame. Then the second compressed frame (the encoded bit-stream) is stored in the memory device 43. The advantage of Huffman's encoding is that when the probability of one datum is higher, the datum has a shorter corresponding code word, thereby achieving better compression ratio. For example, when the probability of the grey level "254" is higher, the grey level "254" can correspond to the shorter code word "0" (one bit, and the value of the bit is "0"). In this way, a single bit "0" in the encoded bit-stream represents the grey level "254", which saves enormous storage space. That is, when one over-drive grey level in the over-drive table has a higher probability, the compression ratio is better after the Huffman's encoding procedure.

Figure 9:
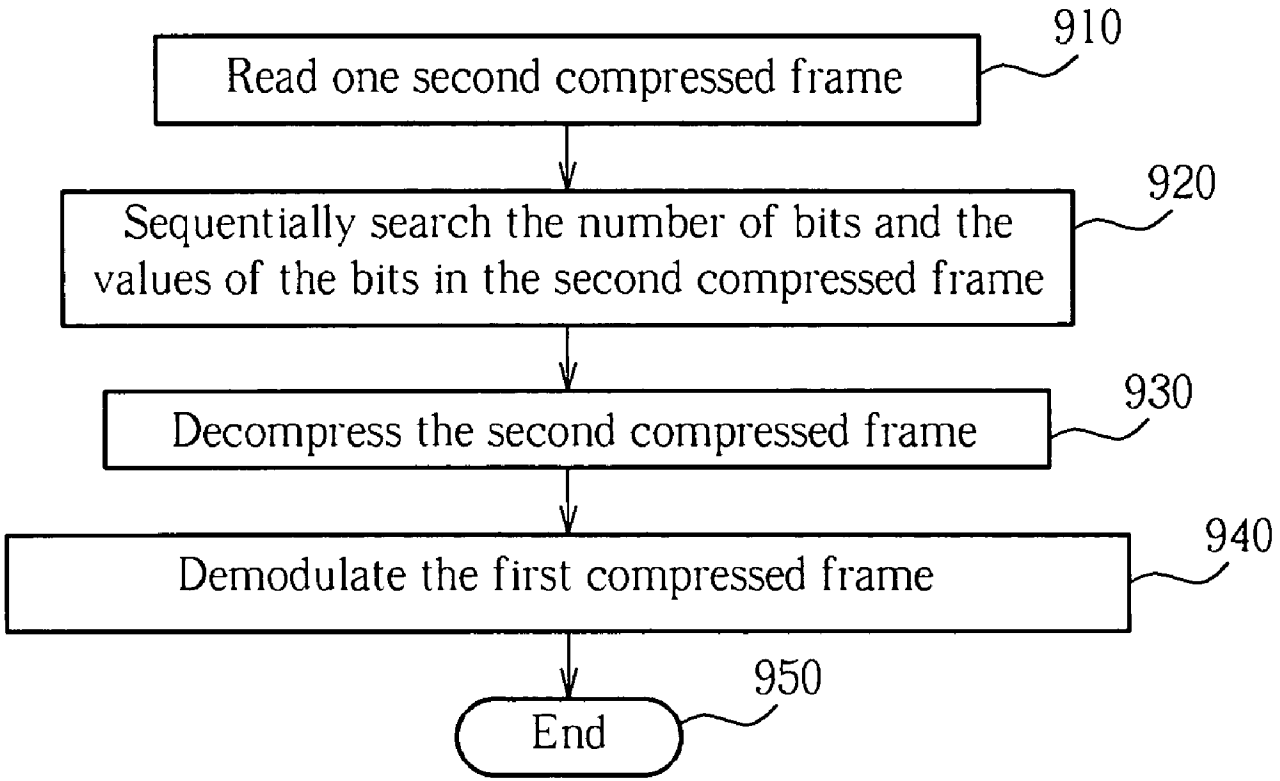
FIG. 9 is a flowchart illustrating the method for the frame decompressing device reading out one second compressed frame stored in the memory device and decompressing the read data to be a corresponding raw frame according to the second embodiment of the present invention.

Please refer to FIG. 9. FIG. 9 is a flowchart illustrating the method 900 for the frame decompressing device 44 reading out one second compressed frame stored in the memory device 43 and decompressing the read data to be a corresponding raw frame according to the second embodiment of the present invention. The steps are described as follows:

Step 910: Read one second compressed frame;

Step 920: Sequentially search the number of bits and the values of the bits in the second compressed frame in compliance with the code words in the code book;

Step 930: Decompress the second compressed frame for generating a corresponding first compressed frame according to the found corresponding code words in the second compressed frame;

Step 940: Demodulate (decompress) the first compressed frame for generating a corresponding raw frame;

Step 950: End.

During steps 910 to 940, the second compressed frames stored in the memory device 43 is read and decompressed to raw frames. By utilizing steps 910 to 940, the needed size of the memory device 43 can be smaller.

In steps 920 and 930 (steps for decoding the second compressed frames encoded with Huffman's encoding), each code word in the code book is saved with number of the bits of the code word and the values of each bit of the code word. In this way, the code book can be smaller. For example, when the code word is "0", the code word "0" is saved with one bit (number of the bits of the code word "0"), and with the value "0" (value of the bit of the code word "0"); when the code word is "100", the code word "100" is saved with three bits (number of the bits of the code word "100"), and with the value "100" (values of the bits of the code word "100"). Therefore, the second compressed frame can be decoded by the code words sequentially searched in the code book. Furthermore, when the probability of the occurrence of one code word in the second compressed frame goes higher, the priority of that code word is raised as well, which speeds up the step for searching. Additionally, in the steps 920 and 930, one second compressed frame (encoded bit-stream) can be divided into sections, and one section begins to decode after the previous section is decoded completely. Although such manner slows down the speed of decoding, the size of the code book is smaller.

Since the first compressed frame is generated by compressing the raw frame with the two-dimensional DPCM in step 820, the reference X also has to be stored in the first compressed frame in order to decompress for generating the corresponding raw frame in step 940.

To sum up, the storage space required for the over-drive table/raw frame can be efficiently reduced by utilizing the compressing/decompressing devices and methods provided by the present invention and the frames displayed on the LCD are not distorted, providing great convenience to users.

Those skilled in the art will readily observe that numerous modifications and alterations of the device and method may be made while retaining the teachings of the invention.

What is claimed is:

1. An over-drive device, comprising:

a memory device for storing a first frame;

wherein the first frame comprises a first original grey level for a pixel;

an over-drive module, comprising:

a compressed over-drive table for storing a plurality of over-drive grey levels;

a table decompressing device for decompressing the plurality of the over-drive grey levels of the compressed over-drive table; and a table buffer for storing the plurality of the over-drive grey levels decompressed from the table decompressing device; and a determining device for receiving a second original grey level of a second frame for the pixel and selecting one of the plurality of the decompressed over-drive grey levels from the table buffer according to the first original grey level for the pixel and the second original grey level for the pixel.

2. The over-drive device of claim 1, wherein the compressed over-drive table is compressed by differential pulse code modulation (DPCM) with a reference grey level.

3. The over-drive device of claim 2, wherein the compressed over-drive table is again compressed by Huffman's coding according to a code book after being compressed by DPCM.

4. The over-drive device of claim 3, wherein the table decompressing device decompresses the compressed over-drive table by Huffman's coding according to the code book, and decompresses the compressed over-drive table decompressed by Huffman's coding according to the code book by DPCM.

5. The over-drive table of claim 1, further comprising:

a frame compressing device for compressing a third frame to be the first frame for storing in the memory device; and a frame decompressing for decompressing the first frame stored in the memory device to be the third frame.

6. The over-drive device of claim 5, wherein the frame compressing device compresses the third frame by DPCM with a reference grey level for generating the first frame.

7. The over-drive device of claim 6, wherein the frame compressing device compresses the third frame compressed by DPCM by Huffman's coding according to a code book to be the first frame.

8. The over-drive device of claim 7, wherein the frame decompressing device decompresses the first frame stored in the memory device by DPCM according to the reference grey level for generating the third frame.

9. The over-drive device of claim 8, wherein the frame decompressing device decompresses the first frame decompressed by DPCM according to the reference grey level by Huffman's coding according to the code book to be the third frame.

10. A method for over-driving a pixel of a liquid crystal display (LCD) with a compressed over-drive table, the method comprising:

compressing a first over-drive table by DPCM for generating a second over-drive table; and compressing the second over-drive table by Huffman's coding according to a code book for generating the compressed over-drive table;

wherein compressing the first over-drive table by DPCM for generating the second over-drivetable is compressing the first over-drive table by two dimensional DPCM for generating the second over-drive table and sequentially searching number of bits and values of the bits of the compressed over-drive table in compliance with code words in the code book; and decompressing the compressed over-drive table for the second over-drive table according to the searched corresponding code words in the compressed over-drive table;

wherein one code word in the code book is stored by number of bits and of the code word and values of the bits of codes word.

11. The method of claim 10, further comprising:

raising priority of the a word to be searched as probability of the code word found in the compressed over-drive table rises.

12. A method for compressing a first frame to be a compressed frame and decompressing the compressed frame to be the first frame, the method comprising:

compressing the first frame by DPCM for generating a second frame; and compressing the second frame by Huffman's coding according to a code book for generating the compressed frame; wherein compressing the first frame by DPCM for generating the second frame is compressing the first frame by two dimensional DPCM for generating the second frame; further comprising sequentially searching number of bits and values of the bits of the compressed frame in compliance with code words in the code book; and decompressing the compressed frame for the second frame according to the searched corresponding code words in the compressed frame;

wherein one code word in the code book is stored by number of bits of the code word and values of the bits of the code word.

13. The method of claim 12, further comprising:

raising priority of a code word to be searched as probability of the code word found in the compressed frame rises.

* * * * *